United States Patent [19]

White

[11] Patent Number: 4,996,403

[45] Date of Patent: Feb. 26, 1991

[54] ACOUSTIC EMISSION FEEDBACK CONTROL FOR CONTROL OF BOILING IN A MICROWAVE OVEN

[75] Inventor: Terry L. White, Oak Ridge, Tenn.

[73] Assignee: The United States of America as represented by the United States Department of Energy, Washington, D.C.

[21] Appl. No.: 474,906

[22] Filed: Feb. 5, 1990

[51] Int. Cl.[5] ..... H05B 6/68

[52] U.S. Cl. ..... 219/10.55 B; 219/10.55 E; 99/325

[58] Field of Search ..... 219/10.55 B, 10.55 R, 219/10.55 E, 10.55 F, 10.55 M; 340/612, 618, 621; 73/632, 644; 99/451, DIG. 14, 325

[56] References Cited

U.S. PATENT DOCUMENTS

| | | | |
|---|---|---|---|
| 3,467,804 | 9/1969 | Smith | 219/10.55 B |
| 4,093,841 | 6/1978 | Dills | 219/10.55 E |
| 4,125,752 | 11/1978 | Wegener | 219/10.55 E |
| 4,341,937 | 7/1982 | Staats | 219/10.55 M |
| 4,520,250 | 5/1985 | Ishihara et al. | 219/10.55 B |
| 4,831,239 | 5/1989 | Ueda | 219/10.55 B |
| 4,870,238 | 9/1989 | Hodgetts et al. | 219/10.55 M |

*Primary Examiner*—Philip H. Leung

*Attorney, Agent, or Firm*—David E. Breeden; Stephen D. Hamel; William R. Moser

[57] ABSTRACT

An acoustic emission based feedback system for controlling the boiling level of a liquid medium in a microwave oven is provided. The acoustic emissions from the medium correlated with surface boiling is used to generate a feedback control signal proportional to the level of boiling of the medium. This signal is applied to a power controller to automatically and continuoulsly vary the power applied to the oven to control the boiling at a selected level.

8 Claims, 2 Drawing Sheets

ACOUSTIC EMISSION FEEDBACK CONTROL FOR CONTROL OF BOILING IN A MICROWAVE OVEN

BACKGROUND OF THE INVENTION

The present invention, which is a result of a contract with the U.S. Department of Energy, relates generally to the art of microwave heating control systems and more specifically to the control of boiling of a liquid in a microwave applicator.

It is frequently useful to boil down liquids and chemical slurries in open containers inside microwave ovens or other microwave applicators in order to study the behavior of microwaves on the boildown process and to measure the off gases produced by this process. The boildown process is best done in a controlled fashion whereby the microwave power absorbed by the liquid is just equal to the heat required to vaporize the liquid at 1 atmosphere pressure. However, continued microwave heating at full power results in uncontrolled boiling and subsequent splattering of the liquid out of the container. For example, lowering the microwave power in a microwave oven offers some reduction in splattering but never completely eliminates the problem because lower power levels are achieved with full power switched on and off at fixed intervals to give the desired average power. The shortest "on" time available in most commercial ovens is about 1 second, and at the boiling threshold of the liquid even a 1 second full power pulse is enough to cause some splattering. Moreover, even a microwave generator and applicator with continuous power control must be constantly monitored by the operator to control the level of boiling instabilities in the liquid. Thus it will be seen that there is a need for a means of controlling the level of boiling of a liquid in a microwave oven or in a microwave applicator.

SUMMARY OF THE INVENTION

In view of the above need, it is an object of this invention to provide a system for controlling the boiling of a liquid at a selected level in a microwave heating system.

Another object of this invention is to provide a system for automatic control of boiling in a microwave heating system wherein the power level is varied by means of acoustic emission feedback to control boiling at a selected level.

Other objects and many of the attendant advantages of the present invention will be obvious to those skilled in the art from the following detailed description of a preferred embodiment of the invention.

Briefly, the present invention is a system for controlling the boiling level of a liquid medium in a microwave heating device comprising means for sensing the acoustic emissions from the medium correlated with surface boiling thereof to generate a feedback control signal proportional to the level of boiling of the medium, means for comparing this feedback signal with a demand signal corresponding to the desired boiling level to generate a control signal proportional to the difference therebetween, and means for automatically and continuously varying the power applied to the microwave heating device in response to the feedback control signal to maintain the selected boiling level of the medium contained within the microwave heating device.

DETAILED DESCRIPTION OF A PREFERRED EMBODIMENT

Figure 1:
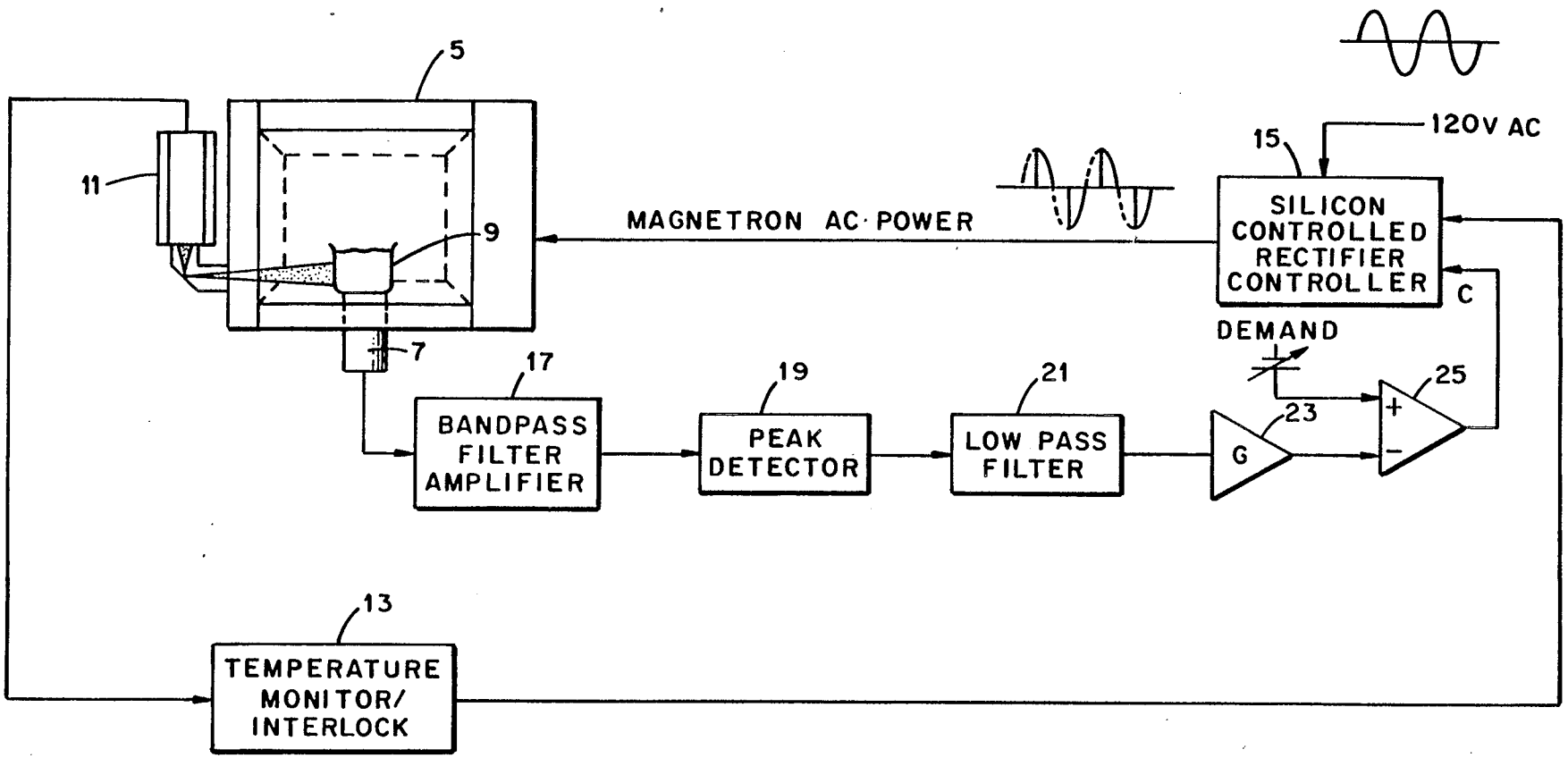
FIG. 1 is block diagram of an acoustic emissions process control loop according to the present invention for controlling the level of boiling of a liquid in a microwave oven.

Referring now to FIG. 1, there is shown an acoustic emissions feedback system for controlling the level of boiling in a microwave oven in accordance with the present invention. The oven 5 may be a commercially available oven, such as a typical 750 W, 2450 MHz magnetron type, modified to receive an acoustic emission detector 7 adapted to fit through an opening in the bottom of the oven 5. The detector is acoustically coupled to a beaker 9 containing a liquid medium to be boiled. The beaker 9 is preferably made of microwave transparent Pyrex or quartz to provide a container that will not only withstand the heat, but will also serve as a good acoustic conductor. The oven may be provided with an additional control loop including an infrared detector 11 coupled through the side of the oven to monitor the beaker temperature and generate a signal proportional thereto which is applied to the input of a temperature monitor/interlock circuit 13. This circuit compares the input signal with a selected maximum signal corresponding to the maximum selected temperature limit and generates an output interlock control signal which is applied to a silicon controlled rectifier power controller 15 to shut off the power to the oven in the event of overheating of the beaker.

The silicon controlled rectifier controller 15 may take the form of a commercially available controller, such as the Model No. 7810 supplied by Electronic Control Systems, Inc., Fairmont, West Virginia. The controller 15 operates in response to a DC control signal of between 0 and 5 volts applied to a control input C thereof to phase-angle-switch the AC output signal "on" and "off" every cycle over a phase angle range corresponding to the control signal input level. This causes the 60 Hz voltage pulses generated from the conventional 120 volt AC input signal to vary in pulse width each half cycle, as illustrated in FIG. 1, and, thus vary the rms power to the primary of the oven's magnetron high voltage transformer (not shown). Thus the microwave power produced in the oven 5 is continuously controlled in proportion to the 0–5 volt DC control signal applied to the control input of the controller 15.

The control signal is generated in response to the acoustic feedback signal from the acoustic emission detector 7. The acoustic feedback signal is applied to the input of a bandpass filter and amplifier circuit 17. The narrow band filter of the circuit 17 is centered at 20 kHz with a 1 kHz bandwidth, corresponding to the desired frequency of the acoustic boiling signal. The amplified (typically 50 dB) signal from the output of the bandpass filter circuit 17 is applied to the input of a peak detector circuit 19 to produce a demodulated time-varying DC signal proportional to the peak value of the acoustic feedback signal. This signal is applied to the negative input of an operational amplifier 25 through a low-pass filter circuit 21 and a variable amplifier 23. A DC demand signal is applied to the positive input of the amplifier 25. The difference signal, which varies between 0–5 volt DC to produce the desired control signal, is applied to the control input of controller 15 to vary the power to the oven 5 and thus controls the boiling at the selected level.

In order to establish the demand and gain settings for first time operation, the following procedure is performed. In the absence of any acoustic feedback signal, the microwave oven 5 power level is set to a maximum desired level by adjusting the demand signal applied to the (+) input of amplifier 25. The microwave energy is allowed to heat the liquid medium in the beaker 9 until it comes to a mild boil. Then the gain of the acoustic feedback signal is adjusted by varying the gain of amplifier 23 until the desired boiling level is obtained to achieve the desired rate of evaporation of the liquid. This procedure needs to be done only once for the same liquid.

In order to provide a stable control loop, the feedback signal, which is negative, is always less than or equal to the demand signal. During operation, an increase in the acoustic signal will lower the power to the oven by increasing the negative going feedback signal applied to the (−) input of amplifier 25 which lowers the control signal to the control input C of the controller 15, thereby lowering the acoustic boiling signal. In this way, the feedback control loop is self stabilizing as long as the loop gain is not too high.

The response time of the feedback circuit may be made fast enough to prevent splattering of the liquid. The response time of the control system is limited only by the thermal response time of the liquid being evaporated and the acoustic delay in detecting the boiling signal.

As the liquid boils off completely, the acoustic signal level will decrease which will in turn increase the microwave power. Thus to prevent over heating an upper temperature cutoff limit is required. This is provided by the infrared temperature sensor and interlock which disable the controller 15 if the oven temperature exceeds a selected temperature as sensed by the infrared detector 11.

Figure 2:
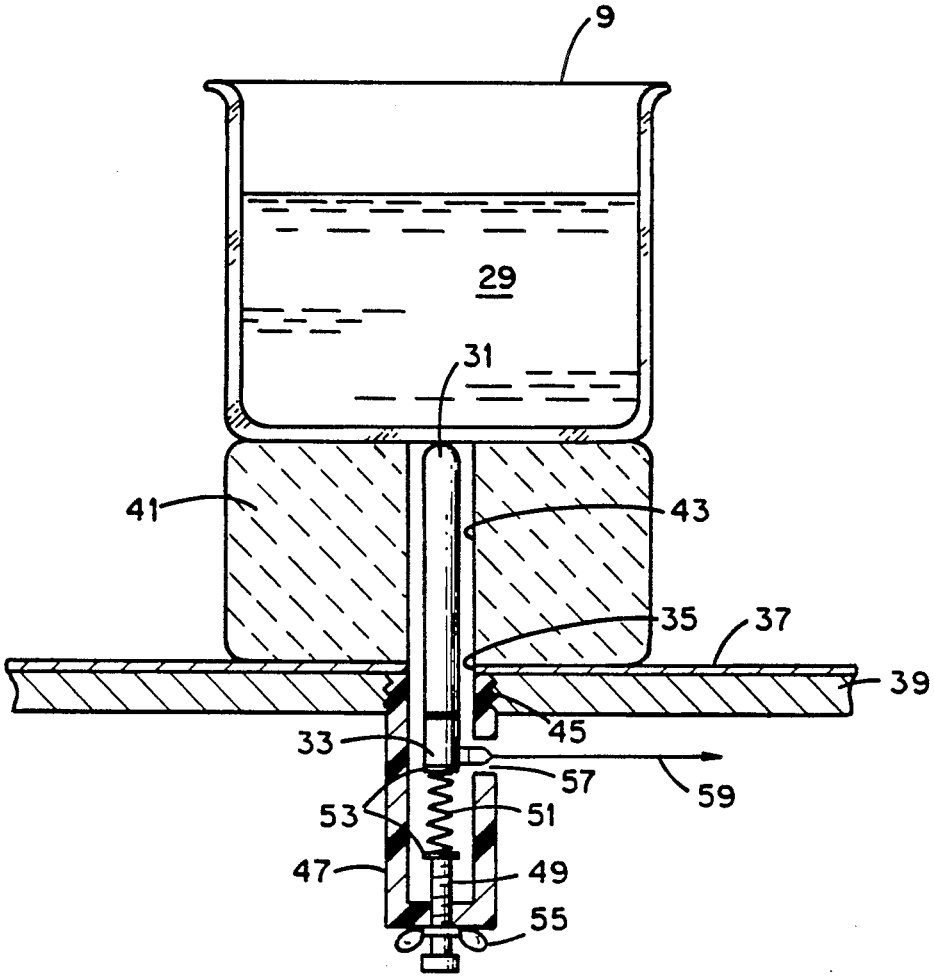
FIG. 2 is a cross-sectioned, elevation view of the acoustic emission detector assembly shown schematically in FIG. 1.

Referring now to FIG. 2, there is shown the preferred means for coupling an acoustic sensor 33 to the liquid container 9 containing a liquid 29 to be boiled down. In order to detect the acoustic signal produced by the boiling of the liquid medium in the beaker 9 in the presence of background sounds within the cavity, such as the oven fan noise which exceeds the boiling noise, an efficient means must be used to couple the acoustic energy produced by the boiling medium within the beaker to the acoustic sensor 33 located outside the oven. This precludes the use of air-coupled microphones to monitor the audible boiling. As shown in FIG. 2, a quartz rod 31, acting as an acoustic signal waveguide, is acoustically coupled between the beaker and an acoustic sensor 33. High temperature silicon grease is applied to each end of the rod to maximize the acoustical coupling between the elements. The rod 31 passes through an opening 35 in the bottom cavity wall 37 and a reinforcing base plate 39. The size of the opening 35 is chosen to be cut off to microwave radiation at the operating frequency of 2450 MHz. The beaker 9 is supported within the oven on a microwave-transparent support member 41 formed of alumina fibers pressed into a low density cylinder which thermally insulates the beaker and prevents microwave oven high frequency acoustic noise from being coupled into the beaker. The support brick 41 has a central opening 43 through which the quartz rod 31 extends to be coupled to the bottom of the beaker 9.

The steel reinforcing base plate 39 is provided to give stability to the acoustic sensor assembly which is threadably mounted into the threaded opening 45 of the plate aligned with the opening 35 in the oven liner 37. The sensor assembly consists of a cylindrical housing 47 having an upper open end threaded into the opening 45 in plate 39 and a closed lower end in which a small compression-adjusting screw 49 is threaded to extend within the housing and engages one end of a compression spring 51 whose opposite end presses against the acoustic sensor 33 and maintains proper coupling between the sensor, rod and beaker. The screw 49 is adjusted to obtain a desired compression for the spring 51 and then locked in position by means of a lock nut 55. Retaining rings 53 on each end of the spring keep the spring centered against the sensor 33 and screw 49. As a result, the sensor, rod, and spring assembly does not touch the walls of the housing 47 or insulating brick 41, which in turn reduces the coupling of extraneous oven vibration into the sensor to a minimum.

The acoustic sensor is preferably a commercially available piezoelectric transducer, such as the Model No. 59223 supplied by Physical Acoustic Corporation, Princeton, New Jersey. The transducer converts the acoustic signals coupled thereto to a corresponding AC electrical signal. The output line 59 of the acoustic sensor 33 exits the housing through a side opening slot 57 and is connected to the input of the filter/amplifier circuit 17, as shown in FIG. 1.

In operation, a liquid medium to be boiled down is placed in the oven 5 in the beaker 9, as shown in FIG. 1. The oven power is turned on and applied until the liquid begins to boil. The surface boiling of a liquid produces acoustic wave energy which has been found to be in the range of about 20 Hz to 40 kHz for a saturated solution of water and $NaNO_3$, although similar frequencies are produced in pure water as well. The frequencies are generated by the formation and collapse of liquid vapor pockets in the liquid being boiled. This acoustic emission is coupled through the beaker 9 and quartz rod 31 to the acoustic sensor 33 (FIG. 2) and the resulting output of the sensor is peak detected to produce a DC feedback signal proportional to the boiling level of the liquid medium. This signal is compared to the demand signal, which may be adjusted to maintain the desired boiling level, as explained above, to vary the control signal to the control input of the controller 15 and thus the power to the oven 5. Once the desired boiling level is obtained the system will maintain the selected boiling level until boildown of the liquid is completed. At this point the acoustic boiling signal decreases, causing the power to the oven to increase. The increase in temperature of the beaker caused by the increase in power will be detected by the infrared temperature sensing detector 11 to trigger the temperature monitor/interlock 13, which in turn switches "off" the silicon controlled rectifier controller 15 thus removing power to the oven.

Thus, it will be seen that a system has been provided for applying acoustic emission feedback signals to automatically control the boiling level of a liquid in a microwave heating device. The method of using acoustic emission to control boiling in microwave heated liquids is applicable to any microwave applicator, and is not limited to a microwave oven. Also, the means for coupling the acoustic emission signal from the liquid to the acoustic sensor may take various forms depending on the application. The acoustic signal waveguide is not limited to a quartz rod but could be any means for coupling acoustic emission signals from the liquid to the sensor. For example, the wall of the applicator may be used as the waveguide if the liquid is contained by the walls of the applicator. Although the invention has been illustrated by means of a detailed description of a preferred embodiment thereof, it will be obvious to those skilled in the art that various other modifications and changes may be made therein without departing from the spirit and scope of the invention as outlined in the following claims appended hereto and forming a part of this specification.

What is claimed is:

1. A system for controlling the boiling level of a liquid medium in a microwave applicator comprising:

a microwave applicator for microwave energy heating of a liquid medium contained therein to be boiled by means of microwave heating;

an acoustic emission sensing means for sensing the acoustic emissions from said liquid medium correlated with surface boiling thereof and generating a feedback signal having an amplitude proportional to the level of boiling of the medium;

a control signal generating means for comparing the amplitude of said feedback signal with the amplitude of a selected demand signal corresponding to a selected boiling level of said liquid to generate a control signal which varies with the difference in amplitude between said demand and said feedback signal; and a power control means responsive to said control signal for automatically and continuously varying the power applied to said applicator to control the boiling level of said liquid medium contained within the applicator at said selected level corresponding to said demand signal.

2. A system as set forth in claim 1 wherein said applicator is a microwave oven having a resonant cavity therein for microwave heating of articles disposed therein and further including a container disposed in said cavity of said oven for containing said liquid medium to be boiled.

3. A system as set forth in claim 2 wherein said acoustic emission sensing means includes an acoustic signal transducer disposed outside of said cavity of said oven for generating an AC electrical signal proportional to the acoustic signal coupled thereto and an acoustic signal waveguide having one end acoustically coupled to said acoustic signal transducer and the other end acoustically coupled to said container disposed within said cavity for transmitting acoustic signals generated by boiling of said medium to said transducer.

4. A system as set forth in claim 3 wherein said acoustic signal transducer is a piezoelectric transducer and wherein said acoustic signal waveguide includes a quartz rod disposed to extend through an opening in a wall of said oven which has a cutoff frequency above the operating microwave frequency of said oven.

5. A system as set forth in claim 3 wherein said acoustic emission sensing means further includes a support member for supporting said container within said cavity of said oven, said support member being formed of a microwave radiation transparent, thermally insulating and acoustically insulating material.

6. A system as set forth in claim 5 wherein said support member is formed of alumina fibers.

7. A system as set forth in claim 2 wherein said control signal generating means includes a bandpass filter circuit having an input and an output, said input connected to receive said feedback signal and a frequency bandpass corresponding to the frequency of said acoustic emissions produced by boiling of said liquid medium, a peak detector circuit connected to the output of said bandpass filter circuit for generating a DC signal at an output thereof proportional to the peak amplitude of the signal from said bandpass filter circuit, and a comparator amplifier having first and second inputs and an output whose signal amplitude is equal to the difference between the first and second input amplitudes, said first input connected to receive said demand signal and said second input connected to the output of said peak detector circuit so that said control signal is generated at the output thereof.

8. A system as set forth in claim 7 wherein said power control means is a silicon controlled rectifier controller having a control input connected to the output of said comparator amplifier.

* * * * *